US011308911B2

(12) United States Patent
Huang

(10) Patent No.: US 11,308,911 B2
(45) Date of Patent: Apr. 19, 2022

(54) DISPLAY DEVICE, DRIVING METHOD, AND DISPLAY SYSTEM

(71) Applicant: HKC CORPORATION LIMITED, Shenzhen (CN)

(72) Inventor: Xiaoyu Huang, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/042,892

(22) PCT Filed: Dec. 13, 2018

(86) PCT No.: PCT/CN2018/120789

§ 371 (c)(1),
(2) Date: Sep. 28, 2020

(87) PCT Pub. No.: WO2020/103229

PCT Pub. Date: May 28, 2020

(65) Prior Publication Data

US 2021/0097952 A1 Apr. 1, 2021

(30) Foreign Application Priority Data

Nov. 21, 2018 (CN) ..... 201811389136.0

(51) Int. Cl.
*G09G 3/36* (2006.01)

(52) U.S. Cl.
CPC ..... *G09G 3/3688* (2013.01); *G09G 3/3677* (2013.01); *G09G 2310/08* (2013.01); *G09G 2320/02* (2013.01); *G09G 2320/0223* (2013.01)

(58) Field of Classification Search
None
See application file for complete search history.

(56) References Cited

U.S. PATENT DOCUMENTS 6,191,769 B1 * 2/2001 Fujiwara ..... G09G 3/3648 345/99
2003/0034965 A1 2/2003 Kim
2009/0160832 A1 * 6/2009 Lee ..... G09G 3/3659 345/205

(Continued)

FOREIGN PATENT DOCUMENTS

CN H09237071 A 9/1997
CN 1664909 A 9/2005
CN 2745164 Y 12/2005

(Continued)

OTHER PUBLICATIONS

Xiaolan Li, the ISA written comments, Aug. 2019, CN.
Xiaolan Li, the International Search Report, dated Aug. 2019, CN.

*Primary Examiner* — Dorothy Harris

(57) ABSTRACT

This application discloses a display device, a driving method, and a display system. The display device includes the display panel, where the display panel includes a scanning line and a data line; a source driver chip arranged to output a source driver signal of the display panel and a gate driver chip arranged to output a gate driver signal of the display panel; a signal delay circuit, where the gate driver signal is output to the scanning line by the signal delay circuit; and the source driver signal is directly output to the data line.

16 Claims, 3 Drawing Sheets

(56) References Cited

U.S. PATENT DOCUMENTS

| | | | | |
|---|---|---|---|---|
| 2013/0278324 | A1* | 10/2013 | Kan | G09G 3/3266<br>327/390 |
| 2019/0180709 | A1* | 6/2019 | Lee | G09G 3/3681 |

FOREIGN PATENT DOCUMENTS

| | | | |
|---|---|---|---|
| CN | 101256760 | A | 9/2008 |
| CN | 101334969 | A | 12/2008 |
| CN | 101620828 | A | 1/2010 |
| JP | 2010117654 | A | 5/2010 |

* cited by examiner

DISPLAY DEVICE, DRIVING METHOD, AND DISPLAY SYSTEM

CROSS REFERENCE OF RELATED APPLICATIONS

This application claims priority to the Chinese Patent Application No. CN201811389136.0, filed with the Chinese Patent Office on Nov. 21, 2018 and entitled "DISPLAY DEVICE, DRIVING METHOD, AND DISPLAY SYSTEM", which is incorporated herein by reference in its entirety.

TECHNICAL FIELD

This application relates to the field of display technologies, and in particular, to a display device, a driving method, and a display system.

BACKGROUND

Statement herein merely provides background information related to this application and does not necessarily constitute the existing technology.

With development and advancement of science and technologies, because of hot spots such as thinness, power saving, and low radiation, flat panel displays become mainstream products of displays and are widely applied. A flat panel display includes a thin film transistor-liquid crystal display (TFT-LCD), an organic light-emitting diode (OLED) display, and the like. The TFT-LCD controls rotating directions of liquid crystal molecules, to enable light in a backlight module to be refracted to generate a picture, and the TFT-LCD has various advantages such as thin body, power saving, and no radiation. The OLED display is manufactured by using an organic electroluminescent diode, and has various advantages such as self-luminescence, a short response time, high resolution and contrast, flexible display, and large area full color display.

The TFT-LCD, as one of the main varieties of current flat panel displays, has become an important display platform of modern IT and video products. In the driving design of the TFT-LCD, the applicant knows that during power-on, a gate driver chip may work normally, while a source driver chip still cannot work normally, leading to abnormal pictures.

SUMMARY

This application provides a display device, a driving method, and a display system, to ensure that a driver chip can work normally during power-on.

To achieve the foregoing objective, this application provides a circuit board, including: a display panel, where the display panel includes a scanning line and a data line; a source driver chip, configured to output a source driver signal of the display panel; a gate driver chip, configured to output a gate driver signal of the display panel; and a signal delay circuit, where the gate driver signal is output to the scanning line by the signal delay circuit; and the source driver signal is directly output to the data line.

Optionally, the signal delay circuit includes a D trigger, a resistor, a power supply, a ground line, a capacitor, and an active switch, a C end of the D trigger is connected to the resistor, another end of the resistor is connected to an output end of the gate driver chip, and a D end of the D trigger is connected to the power supply; an end of the capacitor is connected to the ground line, another end of the capacitor is connected to a control end of the active switch and a Q end of the D trigger, and the signal delay circuit further includes a signal input end and a signal output end; and an output end of the gate driver chip is connected to the scanning line by the active switch.

Optionally, the active switch is a TFT, and a gate of the TFT is connected to the capacitor, a source of the TFT is connected to the output end of the gate driver chip, and a drain of the TFT is connected to the scanning line.

Optionally, a charging time of the capacitor is longer than a display time of a frame of the display panel.

Optionally, the charging, time of the capacitor is equal to the display time of a frame of the display panel.

Optionally, one scanning line corresponds to one signal delay circuit.

Optionally, there are at least two signal delay circuits, and delay time of the signal delay circuits is equal.

Optionally, the signal delay circuit is integrated into the gate driver chip.

Optionally, the display panel includes a display area and a non-display area, the non-display area encloses the display area, the gate driver chip is connected to a first side of the non-display area, and the source driver chip is connected to a second side of the non-display area.

This application further discloses a driving method for a display device. The driving method includes steps of:

outputting a gate driver signal to a scanning line by a signal delay circuit; and directly outputting a source driver signal to a data line.

Optionally, a signal delay output time of the gate driver chip is controlled to be longer than a display time of a frame.

Optionally, the signal delay output time of the gate driver chip is controlled to be equal to the display time of a frame.

This application further discloses a display system, including: a display device, where the display device includes: a display panel, where the display panel includes a scanning line and a data line; a source driver chip, configured to output a source driver signal of the display panel; a gate driver chip, configured to output a gate driver signal of the display panel; a signal delay circuit, where the gate driver signal is output to the scanning line by the signal delay circuit; and the source driver signal is directly output to the data line; and a backlight module, configured to provide a light source for the display device.

Optionally, the signal delay circuit includes a D trigger, a resistor, a power supply, a ground line, a capacitor, and an active switch, a C end of the D trigger is connected to the resistor, another end of the resistor is connected to an output end of the gate driver chip, and a D end of the D trigger is connected to the power supply; an end of the capacitor is connected to the ground line, another end of the capacitor is connected to a control end of the active switch and a Q end of the D trigger, and the signal delay circuit further includes a signal input end and a signal output end; and an output end of the gate driver chip is connected to the scanning line by the active switch.

Optionally, a charging time of the capacitor is longer than or equal to a display time of a frame of the display panel.

Optionally, there are at least two scanning lines, and each scanning line corresponds to one signal delay circuit.

Optionally, the signal delay circuit is integrated into the gate driver chip.

Optionally, the display panel includes a display area and a non-display area, the non-display area encloses the display area, the gate driver chip is connected to a first side of the non-display area, and the source driver chip is connected to a second side of the non-display area.

Compared with a solution that there is no signal delay transmission, in this application, the signal delay circuit is added to the gate driver chip, so that transmission of the gate driver chip is delayed by a display time of a frame, to provide more time for the source driver chip to establish an internal potential, thereby avoiding a case in which during power-on, incomplete establishment of the internal potential of the source driver chip causes abnormal pictures.

BRIEF DESCRIPTION OF DRAWINGS

The drawings included are used for providing understanding of embodiments of this application, constitute part of the specification, and are used for illustrating implementation manners of this application, and interpreting principles of this application together with text description. Apparently, the accompanying drawings in the following descriptions are merely some embodiments of this application, and a person of ordinary skill in the art can also obtain other accompanying drawings according to these accompanying drawings without involving any creative effort. In the accompanying drawings.

DETAILED DESCRIPTION OF EMBODIMENTS

Specific structures and functional details disclosed herein are merely representative, and are intended to describe the objectives of exemplary embodiments of this application. However, this application may be specifically implemented in many alternative forms, and should not be construed as being limited to the embodiments set forth herein.

In the description of this application, it should be understood that orientation or position relationships indicated by the terms such as "center", "transverse", "on", "below", "left", "right", "vertical", "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as limiting of this application. In addition, the terms such as "first" and "second" are used only for the purpose of description, and should not be understood as indicating or implying the relative importance or implicitly specifying the number of the indicated technical features. In the description of this application, unless otherwise stated, "a plurality of" means two or more than two. In addition, the terms "include", "comprise" and any variant thereof are intended to cover non-exclusive inclusion.

In the description of this application, it should be noted that unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. A person of ordinary skill in the art may understand the specific meanings of the foregoing terms in this application according to specific situations.

The terminology used herein is for the purpose of describing specific embodiments only and is not intended to be limiting of exemplary embodiments. As used herein, the singular forms "a", "an" and "the" are intended to include the plural forms as well, unless the context clearly indicates otherwise. It should be further understood that the terms "include" and/or "comprise" when used in this specification, specify the presence of stated features, integers, steps, operations, elements, and/or components, but do not preclude the presence or addition of one or more other features, integers, steps, operations, elements, components, and/or combinations thereof.

This application is described below with reference to the accompanying drawings and optional embodiments.

Figure 1:
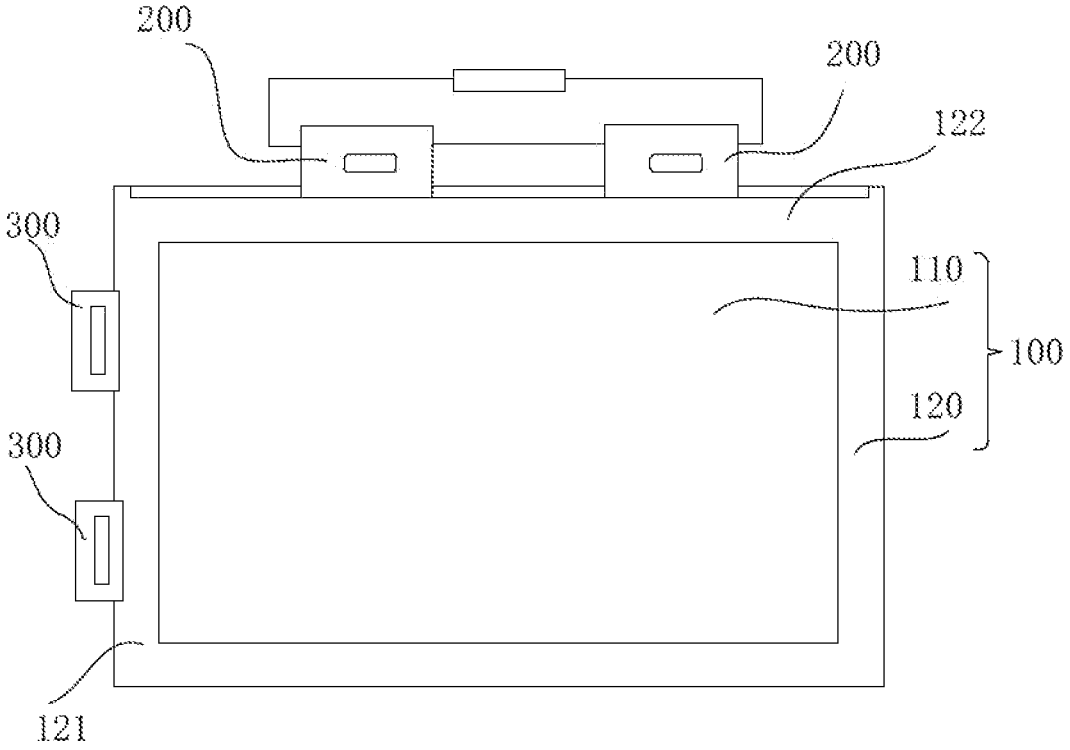
FIG. 1 is a schematic diagram of a display device according to an embodiment of this application.
Figure 2:
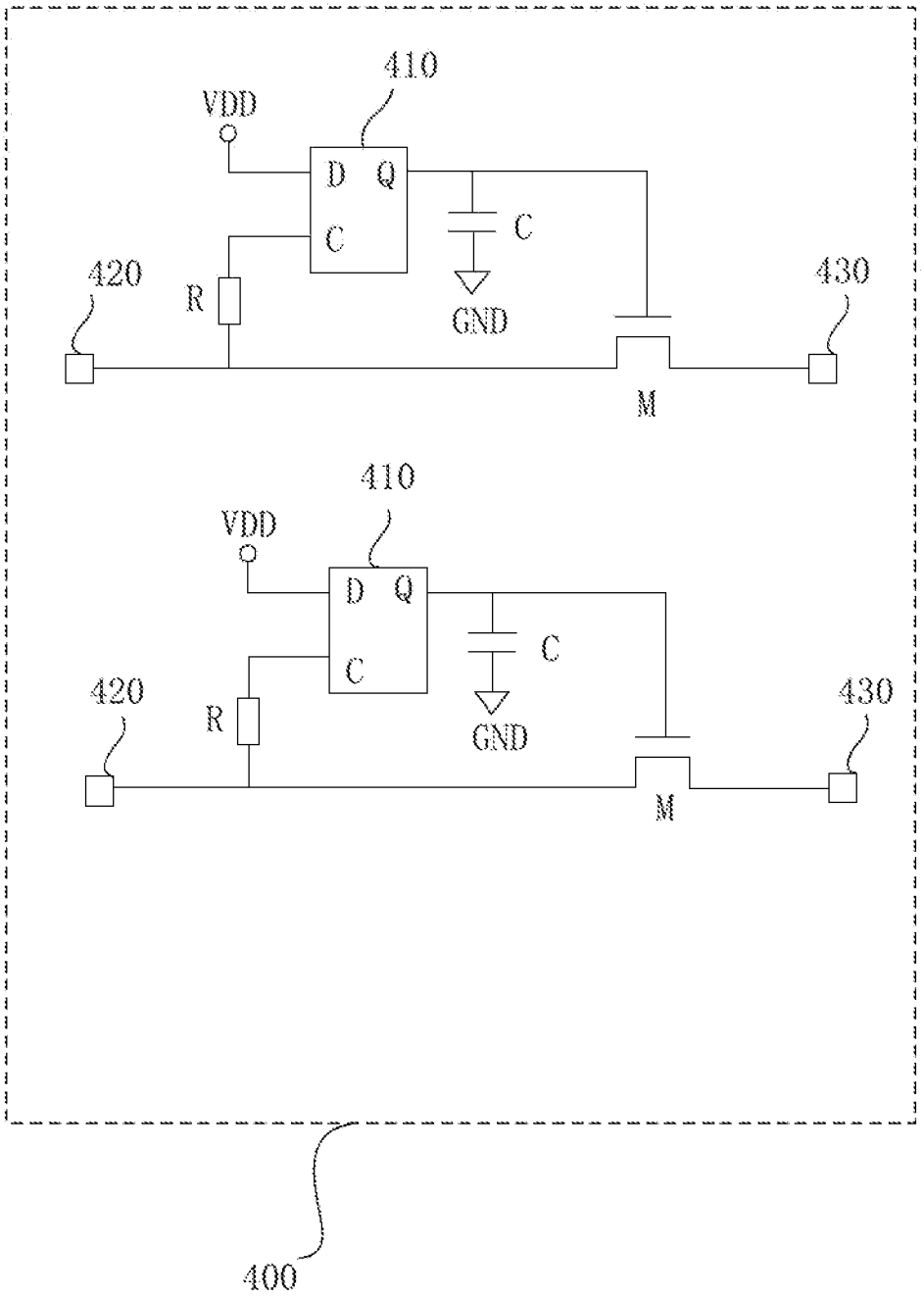
FIG. 2 is a schematic diagram of a signal delay circuit of a display device according to an embodiment of this application.

Referring to FIG. 1 and FIG. 2, an embodiment of this application discloses a circuit board, including: a display panel 100. The display panel 100 includes a scanning line and a data line; a source driver chip 200, configured to output a source driver signal of the display panel 100, and a gate driver chip 300, configured to output a gate driver signal of the display panel 100; and a signal delay circuit 400, where the gate driver signal is output to the scanning line by the signal delay circuit 400, and the source driver signal is directly output to the data line.

In this solution, a TFT-LCD, as one of the main varieties of current flat panel displays, has been widely used in modern IT and video products. In a design, the applicant knows that abnormal pictures may occur during power-on, to be specific, the gate driver chip 300 already starts to work normally while the source driver chip 200 still does not work normally. As normal working time of the gate driver chip 300 and the source driver chip 200 is a time after a system is powered on, a signal of the source driver chip 200 cannot be advanced. In this design, the signal delay circuit 400 is added to the gate driver chip 300 to enable the gate driver signal to transmit a signal to the scanning line by the signal delay circuit 400, to delay transmission of the gate driver signal. In this way, the gate driver signal and the source driver signal can arrive at the display panel 100 at the same time, thereby avoiding abnormal pictures during power-on.

In one or more embodiments, a signal delay circuit includes a D trigger 410, a resistor R, a power supply VDD, a ground line GND, a capacitor C and an active switch M, a C end of the D trigger 410 is connected to the resistor R, another end of the resistor R is connected to an output end of the gate driver chip 300, and a D end of the D trigger 410 is connected to the power supply VDD; an end of the capacitor C is connected to the ground line GND, another end of the capacitor C is connected to a control end of the active switch M and a Q end of the D trigger 410, and the signal delay circuit further includes a signal input end and a signal output end; and an output end of the gate driver chip 300 is connected to the scanning line by the active switch.

In this solution, the power supply VDD is a logical high level and set to H, and the ground line GND is a logical low level and set to L. When a control signal of the gate driver chip 300 is H, the active switch M is started, or when a control signal of the gate driver chip 300 is L, the active switch M is closed. A function of the capacitor C in a circuit is to delay a starting time of the active switch M. In a working state, when the system is powered on, the gate driver chip 300 works normally. When a signal input end 420 primarily outputs a starting signal of a gate, the active switch M is closed, and a signal output end 430 has no output. When the C end of the D trigger 410 receives a rising edge of the signal input end, a high level of the D end of the D trigger 410 is assigned to a Q end, and the capacitor C starts charging. When the capacitor C is charged to the high level, the active switch M is started, and a charging time of the capacitor C is a delay time of the signal delay circuit 400.

In one or more embodiments, the active switch M is a TFT, a gate of the TFT is connected to the capacitor C, a source of the TFT is connected to the output end of the gate driver chip 300, and a drain of the TFT is connected to the scanning line.

In this solution, the TFT is used to control the active switch M, where the gate of the TFT is connected to a capacitor, and the source of the TFT is connected to the output end of the gate driver chip 300, to control the gate driver signal.

In one or more embodiments, the charging time of the capacitor C is longer than or equal to a display time of a frame of the display panel 100.

In this solution, the charging time of the capacitor C is longer than or equal to the display time of a frame of the display panel 100. The gate driver chip 300 that scans a corresponding row for the first time does not output, and the capacitor is charged, and when the gate driver chip 300 scans for the second time, a MOS transistor is started and the gate driver chip 300 outputs normally. The charging time of the capacitor C is longer than or equal to the display time of a frame, to avoid a case in which when the gate driver chip 300 scans for the first time, the capacitor C is charged excessively fast, resulting in starting the MOS transistor in advance.

In one or more embodiments, one scanning line corresponds to one signal delay circuit 400.

In this solution, each signal delay circuit 400 has a corresponding scanning line, and they are in a one-to-one correspondence, to achieve precise control.

In one or more embodiments, there are at least two signal delay circuits 400, and delay time of the signal delay circuits 400 is equal.

In this solution, the signal delay circuit 400 corresponds to one scanning line, and the delay time of the signal delay circuits 400 is equal, to ensure that a time of transmission of the gate driver signal on each scanning line is equal.

In one or more embodiments, the signal delay circuit 400 is integrated into the gate driver chip 300.

In this solution, the signal delay circuit 400 is connected to the gate driver chip 300 and the display panel 100, and a signal output end of the signal delay circuit 400 is a starting signal actually input to the display panel 100 and is connected to the display panel 100. Integration of the signal delay circuit 400 into the gate driver chip 300 can save space and improve space utilization rate.

In one or more embodiments, the display panel 100 includes a display area 110 and a non-display area 120, the non-display area 120 encloses the display area 110, the gate driver chip 300 is connected to a first side 121 of the non-display area 120, and the source driver chip 200 is connected to a second side 122 of the non-display area 120.

In this solution, the gate driver chip 300 is connected to the first side 121 of the non-display area 120, and the second side 122 adjacent to the non-display area 120 is connected to the source driver chip 200. A driver chip is connected to the non-display area 120 and a final signal is transferred to the display area 110 through the non-display area 120.

In one or more embodiments of this application, referring FIG. 1 and FIG. 2, a display device is disclosed, including:

A display panel 100, where the display panel 100 includes a scanning line and a data line; a source driver chip 200, configured to output a source driver signal of a display panel display panel 100; a gate driver chip 300, configured to output a gate driver signal of the display panel 100; and A signal delay circuit 400, where the gate drive signal is output to the scanning line by the signal delay circuit 400; and the source driver signal is directly output to the data line; and the signal delay circuit 400 is integrated into the gate driver chip 300, the signal delay circuit 400 includes a D trigger 410, a resistor R, a power supply VDD, a ground line GND, a capacitor C and an active switch M, a C end of the D trigger 410 is connected to the resistor R, another end of the resistor R is connected to an output end of the gate driver chip 300, and a D end of the D trigger 410 is connected to the power supply VDD; an end of the capacitor C is connected to the ground line GND, another end of the capacitor C is connected to a control end of the active switch M and a Q end of the D trigger 410, and the signal delay circuit further includes a signal input end and a signal output end; and an output end of the gate driver chip 300 is connected to the scanning line by an active switch, and a charging time of the capacitor C is longer than or equal to a display time of a frame of the display panel 100.

In this solution, a TFT-LCD, as one of the main varieties of current flat panel displays, has been widely used in modern IT and video products. In a design, the applicant knows that abnormal pictures may occur during power-on, to be specific, the gate driver chip 300 already starts to work normally while the source driver chip 200 still does not work normally. As normal working, time of the gate driver chip 300 and the source driver chip 200 is time after a system is powered on, a signal of the source driver chip 200 cannot be advanced. In this design, the signal delay circuit 400 is added to the gate driver chip 300 to enable the gate driver signal to transmit a signal to the scanning line by the signal delay circuit 400, to delay transmission of the gate driver signal. In this way, the gate driver signal and the source driver signal can arrive at the display panel 100 at the same time, thereby avoiding abnormal pictures during power-on. The power supply VDD is a logical high level and set to H, and the ground line GND is a logical low level and set to L. When a control signal of the gate driver chip 300 is H, the active switch M is started, or when a control signal of the gate driver chip 300 is L, the active switch M is closed. A function of the capacitor C in a circuit is to delay a starting time of the active switch M. In a working state, when the system is powered on, the gate driver chip 300 works normally. When a signal input end 420 primarily outputs a starting signal of a gate, the active switch M is closed, and a signal output end 430 has no output. When the C end of the D trigger 410 receives a rising edge of the signal input end, a high level of the D end of the D trigger 410 is assigned to Q, and the capacitor C starts charging. When the capacitor C is charged to the high level, the active switch M is started, and a charging time of the capacitor C is a delay time of the signal delay circuit 400. The charging time of the capacitor C is longer than or equal to the display time of a frame of the display panel 100. The gate driver chip 300 that scans a corresponding row for the first time does not output, and the capacitor is charged, and when the gate driver chip 300 scans for the second time, the active switch M is started and the gate driver chip 300 outputs normally. The charging time of the capacitor C is longer than the display time of a frame, to avoid a case in which when the gate driver chip 300 scans for the first time, the capacitor C is charged excessively fast, resulting in starting the active switch M in advance. The signal delay circuit 400 is connected to the gate driver chip 300 and the display panel 100, and a signal output end 420 of the signal delay circuit 400 is a starting signal actually input to the display panel and is connected to the display panel 100. Integration of the signal delay circuit 400 into the gate driver chip 300 can save space and improve space utilization rate.

Figure 3:
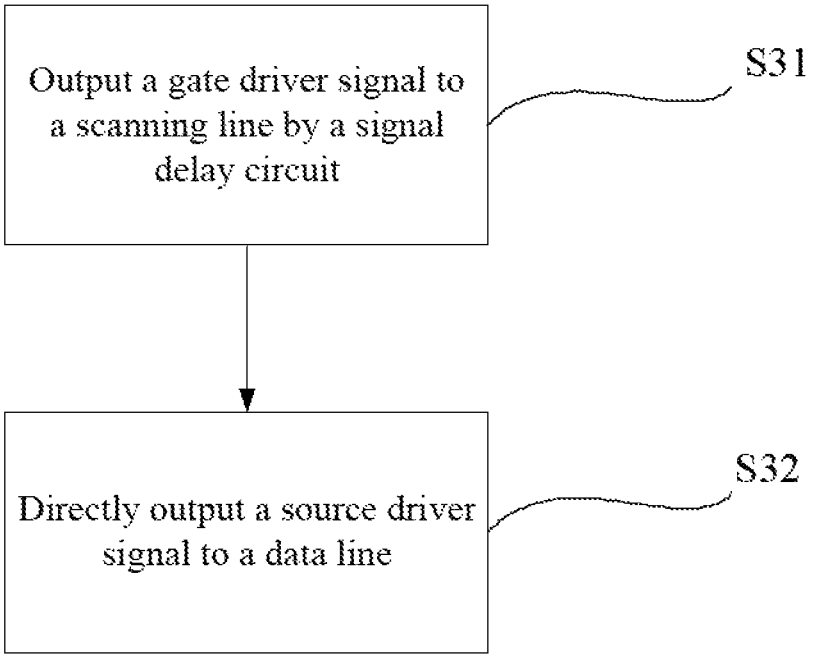
FIG. 3 is a schematic flowchart of a driving method for a display device according to another embodiment of this application.
Figure 4:
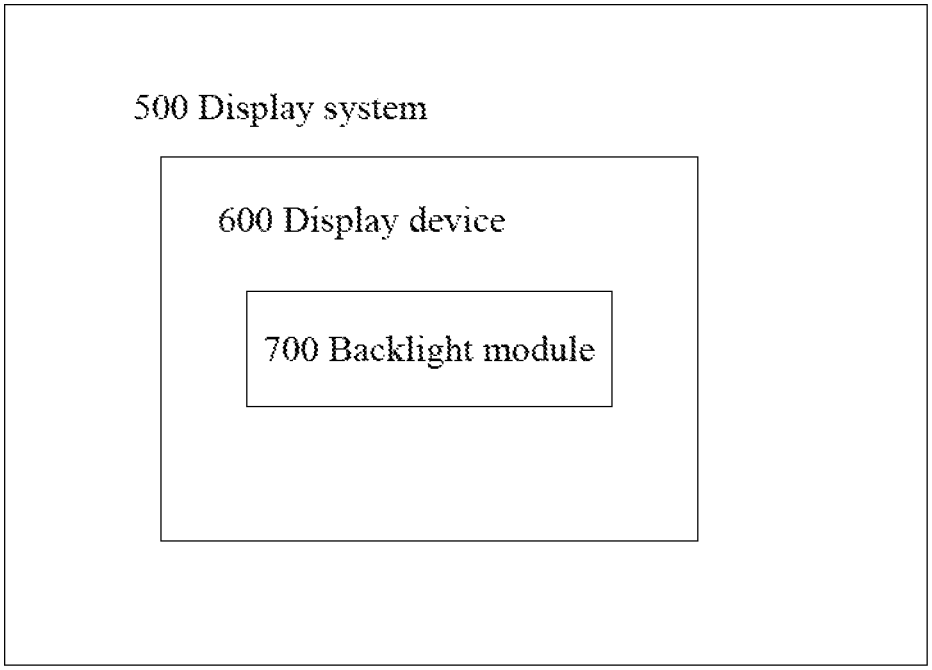
FIG. 4 is a schematic diagram of a display system according to another embodiment of this application.

In one or more embodiments of this application, referring to FIG. 3, a driving method for a display device is disclosed, and the driving method includes steps of:

S11: outputting a gate driver signal to a scanning line by a signal delay circuit; and S12: directly outputting a source driver signal to a data line.

In this solution, when a display panel is powered on, data is transferred to a display area through a gate driver chip and the source driver chip, to enable the display device to obtain a required signal. A delay circuit is added to the gate driver chip to delay the gate driver signal to arrive at the scanning line, thereby avoiding a case in which during power-on, incomplete establishment of internal potential of the source driver chip causes abnormal pictures.

In one or more embodiments, a signal delay output time of the gate driver chip is controlled to be longer than or equal to a display time of a frame.

In this solution, the signal delay output time of the gate driver chip is controlled to make the output time be longer than or equal to the display time of a frame, to avoid a case in which when the gate driver chip scans for the first time, a capacitor is charged excessively fast, resulting in output during scanning for the first time, and affecting image quality.

In one or more embodiments of this application, referring to FIGS. 1 to 4, a display system 500 is disclosed, including: a display device 600. The display device 600 includes: a display panel 100, where the display panel 100 includes a scanning line and a data line; a source driver chip 200, configured to output a source driver signal of the display panel 100, and a gate driver chip 300, configured to output a gate driver signal of the display panel 100; a signal delay circuit 400, where the gate driver signal is output to the scanning line by the signal delay circuit 400, and the source driver signal is directly output to the data line; and a backlight module 700, configured to provide a light source for the display device 600.

In this solution, a TFT-LCD, as one of the main varieties of current flat panel displays, has been widely used in modern IT and video products. In a design, the applicant knows that abnormal pictures may occur during power-on, to be specific, the gate driver chip 300 already starts to work normally while the source driver chip 200 still does not work normally. As normal working time of the gate driver chip 300 and the source driver chip 200 is a time after a system is powered on, a signal of the source driver chip 200 cannot be advanced. In this design, the signal delay circuit 400 is added to the gate driver chip 300 to enable the gate driver signal to transmit a signal to the scanning line by the signal delay circuit, to delay transmission of the gate driver signal. In this way, the gate driver signal and the source driver signal can arrive at the display panel 100 at the same time, thereby avoiding abnormal pictures during power-on.

In one or more embodiments, a signal delay circuit includes a D trigger 410, a resistor R, a power supply VDD, a ground line GND, a capacitor C and an active switch M, a C end of the D trigger 410 is connected to the resistor R, another end of the resistor R is connected to an output end of the gate driver chip 300, and a D end of the D trigger 410 is connected to the power supply VDD; an end of the capacitor C is connected to the ground line GND, another end of the capacitor C is connected to a control end of the active switch M and a Q end of the D trigger 410, and the signal delay circuit further includes a signal input end and a signal output end; and an output end of the gate driver chip 300 is connected to the scanning line by an active switch.

In this solution, the power supply VDD is a logical high level and set to H, and the ground line GND is a logical low level and set to L. When a control signal of the gate driver chip 300 is H, the active switch M is started, or when a control signal of the gate driver chip 300 is L, the active switch M is closed. A function of the capacitor C in a circuit is to delay a starting time of the active switch M. In a working state, when the system is powered on, the gate driver chip 400 works normally. When a signal input end 420 primarily outputs a starting signal of a gate, the active switch M is closed, and a signal output end 430 has no output. When the C end of the D trigger 410 receives a rising edge of a signal input end, a high level of the D end of the D trigger 410 is assigned to Q, and the capacitor C starts charging. When the capacitor C is charged to the high level, the active switch M is started, and a charging time of the capacitor C is a delay time of the signal delay circuit 400.

In one or more embodiments, the charging time of the capacitor C is longer than or equal to a display time of a frame of the display panel 100.

In this solution, the charging time of the capacitor C is longer than or equal to the display time of a frame of the display panel 100. The gate driver chip 300 that scans a corresponding row for the first time does not output, and the capacitor is charged, and when the gate driver chip 300 scans for the second time, a MOS transistor is started and the gate driver chip 300 outputs normally. The charging time of the capacitor C is longer than or equal to the display time of a frame, to avoid a case in which when the gate driver chip 300 scans for the first time, the capacitor C is charged excessively fast, resulting in starting the MOS transistor in advance.

In one or more embodiments, there are at least two signal delay circuits 400, and delay time of the signal delay circuits 400 is equal.

In this solution, the signal delay circuit 400 corresponds to one scanning line, and the delay time of the signal delay circuits 400 is equal, to ensure that a time of transmission of the gate driver signal on each scanning line is equal.

In one or more embodiments, the signal delay circuit 400 is integrated into the gate driver chip 300.

In this solution, the signal delay circuit 400 is connected to the gate driver chip 300 and the display panel 100, and a signal output end of the signal delay circuit 400 is a starting signal actually input to the display panel 100 and is connected to the display panel 100. Integration of the signal delay circuit 400 into the gate driver chip 300 can save space and improve space utilization rate.

In one or more embodiments, the display panel 100 includes a display area 110 and a non-display area 120, the non-display area 120 encloses the display area 110, the gate driver chip 300 is connected to a first side 121 of the non-display area 120, and the source driver chip 200 is connected to a second side 122 of the non-display area 120.

In this solution, the gate driver chip 300 is connected to the first side 121 of the non-display area 120, and the second side 122 adjacent to the non-display area 120 is connected to the source driver chip 200. A driver chip is connected to the non-display area 120 and a final signal is transferred to the display area 110 through the non-display area 120.

It should be noted that the sequence numbers of steps involved in a specific solution should not be considered as limiting the order of steps as long as the implementation of this solution is not affected. The steps appearing earlier may be executed earlier than, later than, or at the same time as those appearing later. Such implementations shall all be considered as falling within the protection scope of this application as long as this solution can be implemented.

The technical solution of this application may be widely applied to a Twisted Nematic (TN) panel, an In-Plane Switching (IPS) panel, or a Multi-domain Vertical Alignment (VA) panel, and may certainly be applied to any other suitable type of panel.

The foregoing contents are detailed descriptions of this application in conjunction with specific, optional embodiments, and it should not be considered that the specific implementation of this application is limited to these descriptions. A person of ordinary skill in the art can further make simple deductions or replacements without departing from the concept of this application, and such deductions or replacements should all be considered as falling within the protection scope of this application.

What is claimed is:

1. A display device, comprising:

a display panel, wherein the display panel comprises a scanning line and a data line;

a source driver chip, configured to output a source driver signal of the display panel;

a gate driver chip, configured to output a gate driver signal of the display panel; and a signal delay circuit, wherein the gate driver signal is output to the scanning line by the signal delay circuit; and the source driver signal is directly output to the data line;

wherein the signal delay circuit comprises a D trigger, a resistor, a power supply, a ground line, a capacitor, and an active switch, a C end of the D trigger is connected to the resistor, another end of the resistor is connected to an output end of the gate driver chip, and a D end of the D trigger is connected to the power supply; an end of the capacitor is connected to the ground line, another end of the capacitor is connected to a control end of the active switch and a Q end of the D trigger, and the signal delay circuit further comprises a signal input end and a signal output end; and an output end of the gate driver chip is connected to the scanning line by the active switch.

2. The display device according to claim 1, wherein the active switch is a thin film transistor (TFT), and a gate of the TFT is connected to the capacitor, a source of the TFT is connected to the output end of the gate driver chip, and a drain of the TFT is connected to the scanning line.

3. The display device according to claim 1, wherein a charging time of the capacitor is longer than a display time of a frame of the display panel.

4. The display device according to claim 1, wherein a charging time of the capacitor is equal to a display time of a frame of the display panel.

5. The display device according to claim 1, wherein one scanning line corresponds to one signal delay circuit.

6. The display device according to claim 5, wherein there are at least two signal delay circuits, and delay time of the signal delay circuits is equal.

7. The display device according to claim 1, wherein the signal delay circuit is integrated into the gate driver chip.

8. The display device according to claim 1, wherein the display panel comprises a display area and a non-display area, the non-display area encloses the display area, the gate driver chip is connected to a first side of the non-display area, and the source driver chip is connected to a second side of the non-display area.

9. A driving method for a display device, comprising steps of:

outputting a gate driver signal to a scanning line by a signal delay circuit; and directly outputting a source driver signal to a data line;

wherein the signal delay circuit comprises a D trigger, a resistor, a power supply, a ground line, a capacitor, and an active switch, a C end of the D trigger is connected to the resistor, another end of the resistor is connected to an output end of a gate driver chip of the display device, and a D end of the D trigger is connected to the power supply; an end of the capacitor is connected to the ground line, another end of the capacitor is connected to a control end of the active switch and a Q end of the D trigger, and the signal delay circuit further comprises a signal input end and a signal output end; and an output end of a gate driver chip of the display device is connected to the scanning line by the active switch.

10. The driving method for a display device according to claim 9, comprising: controlling a delay output time of a gate driver chip signal to be longer than a display time of a frame.

11. The driving method for a display device according to claim 9, comprising: controlling a delay output time of a gate driver chip signal to be equal to a display time of a frame.

12. A display system, comprising a display device, wherein the display device comprises:

a display panel, wherein the display panel comprises a scanning line and a data line;

a source driver chip, configured to output a source driver signal of the display panel;

a gate driver chip, configured to output a driver signal of the display panel;

a signal delay circuit, wherein the gate driver signal is output to the scanning line by the signal delay circuit; and the source driver signal is directly output to the data line; and a backlight module, configured to provide a light source for the display device;

wherein the signal delay circuit comprises a D trigger, a resistor, a power supply, a ground line, a capacitor, and an active switch, a C end of the D trigger is connected to the resistor, another end of the resistor is connected to an output end of the gate driver chip, and a D end of the D trigger is connected to the power supply; an end of the capacitor is connected to the ground line, another end of the capacitor is connected to a control end of the active switch and a Q end of the D trigger, and the signal delay circuit further comprises a signal input end and a signal output end; and an output end of the gate driver chip is connected to the scanning line by the active switch.

13. The display system according to claim 12, wherein a charging time of the capacitor is longer than or equal to a display time of a frame of the display panel.

14. The display system according to claim 12, wherein there are at least two scanning lines, and each scanning line corresponds to one signal delay circuit.

15. The display system according to claim 12, wherein the signal delay circuit is integrated into the gate driver chip.

16. The display system according to claim 12, wherein the display panel comprises a display area and a non-display area, the non-display area encloses the display area, the gate driver chip is connected to a first side of the non-display area, and the source driver chip is connected to a second side of the non-display area.

* * * * *